US012590457B2

(12) United States Patent
Losser et al.

(10) Patent No.: US 12,590,457 B2
(45) Date of Patent: Mar. 31, 2026

(54) SYSTEM AND METHOD FOR MOUNTING A PANEL TO AN INTERNAL FRAME OF A MODULAR WALL

(71) Applicant: FELLOWES, INC., Itasca, IL (US)

(72) Inventors: James Edward Losser, St. Charles, IL (US); Shawn M. Applegate, Streamwood, IL (US); Tai Hoon K. Matlin, Round Lake Beach, IL (US)

(73) Assignee: FELLOWES, INC., Itasca, IL (US)

( * ) Notice: Subject to any disclaimer, the term of this patent is extended or adjusted under 35 U.S.C. 154(b) by 264 days.

(21) Appl. No.: 18/143,478

(22) Filed: May 4, 2023

(65) Prior Publication Data

US 2023/0358036 A1 Nov. 9, 2023

Related U.S. Application Data

(60) Provisional application No. 63/338,274, filed on May 4, 2022.

(51) Int. Cl.
*E04B 2/74* (2006.01)

(52) U.S. Cl.
CPC .... *E04B 2/7425* (2013.01); *E04B 2002/7466* (2013.01)

(58) Field of Classification Search
CPC ..... E04B 2/7425; E04B 2002/7466; E04B 2002/7464; E04B 2/789; E04B 2002/7487; E04B 2/7457
See application file for complete search history.

(56) References Cited

U.S. PATENT DOCUMENTS 3,180,457 A 4/1965 Bohnsack
3,292,328 A 12/1966 Lewis et al.
(Continued)

FOREIGN PATENT DOCUMENTS

CA 2516083 C 3/2013
DE 102004054430 A1 5/2006
(Continued)

OTHER PUBLICATIONS

International Preliminary Report on Patentability issued in International Patent Application No. PCT/US2023/021053, dated Aug. 1, 2024.
(Continued)

*Primary Examiner* — Rodney Mintz
(74) *Attorney, Agent, or Firm* — Pillsbury Winthrop Shaw Pittman LLP

(57) ABSTRACT

A clip for mounting a panel to an internal frame of a modular wall is provided. The frame comprises vertical frame members with a plurality of vertically arranged mounting openings. The clip comprises a mounting portion for attaching the clip to the panel, a mounting insert extending in an insertion direction for insertion into one of the mounting openings on one of the vertical frame members with a longitudinal direction of the clip aligned in the vertical direction of the vertical frame member, and an alignment member offset from the mounting insert in a lateral direction of the clip. The alignment member may extend further in the insertion direction than the mounting insert and being configured such that contact of the alignment member with a vertical edge of the vertical frame member aligns the mounting insert in the lateral direction with the corresponding mounting opening for insertion therein.

4 Claims, 16 Drawing Sheets

(56) References Cited

U.S. PATENT DOCUMENTS 4,527,370 A 7/1985 Schuette
5,348,385 A 9/1994 Berg
5,802,789 A 9/1998 Goodman et al.
5,816,001 A 10/1998 Goodman et al.
5,826,385 A 10/1998 Dykstra et al.
6,112,485 A 9/2000 Beyer et al.
6,148,567 A * 11/2000 DeRuiter ..... E04B 2/7422 52/239
6,276,103 B1 8/2001 Waalkes et al.
6,301,846 B1 10/2001 Waalkes et al.
6,418,671 B1 7/2002 DeRuiter et al.
6,546,684 B2 4/2003 Waalkes et al.
6,684,929 B2 2/2004 Slager et al.
6,688,056 B2 2/2004 Von Hoyningen Huene et al.
6,751,914 B2 6/2004 Zeh et al.
6,775,953 B2 8/2004 Burken et al.
6,883,277 B2 4/2005 Wiechecki et al.
7,603,821 B2 10/2009 Eberlein et al.
7,712,260 B2 5/2010 Vardaro et al.
7,845,384 B2 12/2010 Goodman et al.
8,015,767 B2 9/2011 Glick et al.
8,033,059 B2 10/2011 Contois et al.
8,601,749 B2 12/2013 Von Hoyningen Huene et al.
8,910,435 B2 12/2014 Feldpausch et al.
9,174,826 B1 11/2015 Nieves et al.
9,206,827 B2 12/2015 Loree et al.
9,249,567 B2 2/2016 Yu et al.
9,284,729 B2 3/2016 Von Hoyningen Huene et al.
9,593,481 B2 3/2017 Gosling et al.
9,611,641 B2 4/2017 Hamilton et al.
9,650,785 B2 5/2017 Yu et al.
9,803,361 B2 10/2017 Von Hoyningen Huene et al.
RE46,929 E 7/2018 Gosling et al.
10,060,556 B2 8/2018 Leo, Sr. et al.
RE47,693 E 11/2019 Gosling et al.
10,920,418 B2 2/2021 Gosling et al.
10,927,545 B2 2/2021 Von Hoyningen Huene et al.
11,142,901 B2 * 10/2021 Friedlos ..... E04B 1/2403
11,332,924 B2 * 5/2022 Marshall ..... E04B 2/7407
12,134,888 B2 * 11/2024 Marshall ..... E04B 2/789
12,410,611 B2 * 9/2025 Applegate ..... E04B 2/7422
2002/0029529 A1 * 3/2002 Waalkes ..... E04B 2/7433 52/36.5
2002/0121056 A1 * 9/2002 Von Hoyningen Huene ..... E04B 2/745 52/241
2003/0089057 A1 * 5/2003 Wiechecki ..... E04B 2/7427 52/238.1
2003/0155083 A1 * 8/2003 MacDonald ..... E04B 2/7425 160/135
2003/0163958 A1 * 9/2003 Zeh ..... A47B 83/001 52/36.5
2003/0221384 A1 * 12/2003 Burken ..... E04B 2/7425 52/489.1
2006/0000187 A1 1/2006 Hager et al.
2006/0032186 A1 * 2/2006 Vardaro ..... E04B 2/7422 52/782.1
2006/0101724 A1 5/2006 Hoekstra et al.
2006/0162268 A1 * 7/2006 Eberlein ..... E04B 2/7425 52/236.9
2007/0284062 A1 * 12/2007 Contois ..... E04B 2/7422 160/182
2008/0104922 A1 * 5/2008 Glick ..... E04B 2/7425 52/630
2009/0044918 A1 * 2/2009 Goodman ..... E05B 65/0085 160/202
2009/0109575 A1 4/2009 McCoy-Deedler
2009/0293388 A1 * 12/2009 Feldpausch ..... E04B 2/7422 52/239
2009/0293402 A1 * 12/2009 Hamilton ..... E04B 2/7422 52/481.2
2012/0317899 A1 * 12/2012 Von Hoyningen Huene ..... E04B 2/7453 52/127.7
2013/0000224 A1 * 1/2013 Von Hoyningen Huene ..... E04C 2/30 52/126.4
2013/0025220 A1 * 1/2013 Yu ..... E04C 2/521 52/243
2014/0138332 A1 * 5/2014 Loree ..... F16B 2/22 403/326
2015/0075086 A1 * 3/2015 Gosling ..... E04B 2/7407 52/29
2015/0211228 A1 * 7/2015 Gosling ..... A47B 3/00 52/27
2015/0354212 A1 * 12/2015 Von Hoyningen Huene ..... E04B 2/7457 52/745.1
2016/0160500 A1 * 6/2016 Yu ..... E04B 2/7425 52/243.1
2017/0350539 A1 * 12/2017 Leo, Sr. ..... F16L 3/237
2020/0024846 A1 * 1/2020 Von Hoyningen Huene ..... E04B 2/745
2020/0318339 A1 * 10/2020 Friedlos ..... E04B 2/7437
2021/0172168 A1 6/2021 Von Hoyningen Huene et al.
2021/0180315 A1 * 6/2021 Marshall ..... E04B 2/7407
2022/0154451 A1 * 5/2022 Marshall ..... E04B 1/5818
2023/0313527 A1 * 10/2023 Applegate ..... E04B 2/7437 52/745.1

FOREIGN PATENT DOCUMENTS

DE 202018103900 U1 10/2018
EP 1094167 A2 4/2001
GB 1504345 A 3/1978
GB 2510750 A 8/2014
GB 2522208 A 7/2015
WO 98/51876 A1 11/1998
WO 2000024981 A1 5/2000
WO 2010/124832 A2 11/2010
WO 2012/033463 A1 3/2012

OTHER PUBLICATIONS

International Search Report and Written Opinion issued in International Patent Application No. PCT/US2023/021053, dated Aug. 9, 2023.

* cited by examiner

SYSTEM AND METHOD FOR MOUNTING A PANEL TO AN INTERNAL FRAME OF A MODULAR WALL

This application claims the benefit under 35 USC 119(e) of prior U.S. Provisional Patent Application Ser. No. 63/338,274, filed May 4, 2022, which is hereby incorporated by reference in its entirety.

BACKGROUND

Field

The present patent application relates to modular walls or modular wall systems, and particularly systems and methods for mounting a panel to an internal frame of a modular wall.

Description of Related Art

Architectural wall systems (also called modular wall systems) are designed to easily subdivide open spaces into offices, conferences rooms and open spaces using prefabricated components. Because they are designed to be put up and taken down and add no additional stability to the building itself (that is, they are not load bearing walls), they are utilized to save time during the remodeling and construction phases by architects and contractors along with interior designers. The materials used in these walls systems may vary but may typically include glass, aluminum, steel, and a variety of wall panel materials such as gypsum, fiberboard, hardboard to name a few.

Architectural wall systems may take either a stick-built approach, where most of the work may be done on-site typically using aluminum extrusions cut to size and assembled along with locally acquired glass or solid panels, or alternatively, may use unitized walls. The unitized walls may be wall sections that have been preassembled off-site at a factory or a manufacturing facility with the final placement of the preassembled sections into wall runs are done on-site. These types of systems are attractive to architects and designers since they emulate the look of finished walls and are sold to them as being flexible and modular to the point of being re-usable.

The present patent application endeavors to provide improvements in the architectural wall systems.

SUMMARY

In one embodiment of the present patent application, a clip for mounting a panel to an internal frame of a modular wall is provided. The frame may comprise vertical frame members with a plurality of vertically arranged mounting openings. The clip may comprise a mounting portion for attaching the clip to the panel; a mounting insert extending in an insertion direction for insertion into one of the mounting openings on one of the vertical frame members with a longitudinal direction of the clip aligned in the vertical direction of the vertical frame member; and an alignment member offset from the mounting insert in a lateral direction of the clip. The alignment member may extend further in the insertion direction than the mounting insert and may be configured such that contact of the alignment member with a vertical edge of the vertical frame member aligns the mounting insert in the lateral direction with the corresponding mounting opening for insertion therein.

In another embodiment of the present patent application, a method of mounting a panel to at least two vertical frame members of an internal frame of a modular wall is provided. The panel may have a plurality of clips and each vertical frame member having a plurality of vertically arranged mounting openings. The clip may comprise a mounting portion for attaching the clip to the panel, a mounting insert extending in an insertion direction for insertion into one of the mounting openings on one of the vertical frame members with a longitudinal direction of the clip aligned in the vertical direction of the vertical frame member, and an alignment member offset from the mounting insert in a lateral direction of the clip. The alignment member may extend further in the insertion direction than the mounting insert and is configured such that contact of the alignment member with a vertical edge of the vertical frame member aligns the mounting insert in the lateral direction with the corresponding mounting opening for insertion therein. The method may comprise positioning the panel adjacent the vertical frame members; inserting the mounting insert of each clip into a corresponding mounting opening of the vertical frame member, including contacting the alignment members of the clips with vertical edges of the vertical frame members to align each mounting insert in the lateral direction of the clip with its corresponding mounting opening during the insertion.

In yet another embodiment of the present patent application, a clip system for mounting a panel to an internal frame of a modular wall is provided. The frame may comprise vertical frame members with a plurality of vertically arranged mounting openings. The clip system may comprise a panel clip and a frame clip. The panel clip may comprise a panel clip body for mounting to the panel and a mounting projection extending from the panel clip body to project downwardly during mounting of the panel. The frame clip may comprise a frame clip body, at least two mounting inserts extending from the body in an insertion direction, and panel support projection. The mounting inserts may be spaced apart from one another in a longitudinal direction of the clip for insertion into respective mounting openings on one of the vertical frame members with the longitudinal direction of the clip aligned in the vertical direction of the vertical frame member. The panel support projection may extend from the frame clip body opposite the mounting inserts to provide a receiving space that faces upwardly when the frame clip is mounted to the vertical frame member to receive the mounting projection of the panel clip for supporting the panel.

In yet another embodiment of the present patent application, a method of mounting a panel to at least two vertical frame members of an internal frame of a modular wall using a clip system is provided. The clip system may comprise a panel clip and a frame clip. The panel clip comprises a panel clip body for mounting to the panel and a mounting projection extending from the panel clip body to project downwardly during mounting of the panel. The frame clip may comprise a frame clip body, at least two mounting inserts extending from the body in an insertion direction, and panel support projection. The mounting inserts may be spaced apart from one another in a longitudinal direction of the clip for insertion into respective mounting openings on one of the vertical frame members with the longitudinal direction of the clip aligned in the vertical direction of the vertical frame member. The panel support projection may extend from the frame clip body opposite the mounting inserts to provide a receiving space that faces upwardly when the frame clip is mounted to the vertical frame member to receive the mounting projection of the panel clip for supporting the panel. Each vertical frame member may have a plurality of vertically arranged mounting openings and the panel having the panel clips mounted thereto. The method may comprise inserting the mounting inserts of each frame clip into respective mounting openings of the vertical frame member with the receiving space facing upwardly; positioning the panel adjacent the vertical frame members; and inserting the mounting projections of the panel clips into the receiving space on the frame clips to support the panel on the vertical frame members.

In yet another embodiment of the present patent application, a panel and clip system for mounting the panel to an internal frame of a modular wall is provided. The frame may comprise vertical frame members with a plurality of vertically arranged mounting openings. The panel and clip system may comprise a panel, a plurality of clip supports, and a plurality of clips. The panel may have at least a first series of two or more vertically arranged slots and a second series of two or more vertically arranged slots spaced laterally apart from the first series. Each of the plurality of clip supports may have at least one mounting opening formed therethrough. The clip supports may be attached to the panel such that each clip support is positioned over a corresponding one of the vertically arranged slots with the mounting opening thereof aligned with the corresponding slot. Each of the plurality of clips may have a body, a frame mounting insert extending from the body in a frame insertion direction for insertion into a corresponding mounting opening on one of the vertical frame members, and a panel mounting insert for extending in a panel insertion direction opposite the frame insertion direction for insertion into a corresponding mounting opening on one of the clip supports so as to extend into the corresponding vertically arranged slot on the panel.

In yet another embodiment of the present patent application, a method of mounting a panel to at least two vertical frame members of an internal frame of a modular wall using a panel and clip system. The panel and clip system may comprise a panel, a plurality of clip supports, and a plurality of clips. The panel may have at least a first series of two or more vertically arranged slots and a second series of two or more vertically arranged slots spaced laterally apart from the first series. Each of the plurality of clip supports may have at least one mounting opening formed therethrough. The clip supports may be attached to the panel such that each clip support is positioned over a corresponding one of the vertically arranged slots with the mounting opening thereof aligned with the corresponding slot. Each of the plurality of clips may have a body, a frame mounting insert extending from the body in a frame insertion direction for insertion into a corresponding mounting opening on one of the vertical frame members, and a panel mounting insert for extending in a panel insertion direction opposite the frame insertion direction for insertion into a corresponding mounting opening on one of the clip supports so as to extend into the corresponding vertically arranged slot on the panel. Each vertical frame member may have a plurality of vertically arranged mounting openings and the panel having the panel clips mounted thereto. The method may comprise mounting the clips to the clip supports attached to the panel by inserting each panel mounting inserts of the clips in the panel insertion direction into a corresponding mounting opening on one of the clip supports so as to extend into the corresponding vertically arranged slot on the panel; and mounting the clips to the vertical frame members by inserting each frame mounting insert in the frame insertion direction into a corresponding mounting opening on one of the vertical frame members. The clips may support the panel on the vertical frame members.

These and other aspects of the present patent application, as well as the methods of operation and functions of the related elements of structure and the combination of parts and economies of manufacture, will become more apparent upon consideration of the following description with reference to the accompanying drawings, all of which form a part of this specification, wherein like reference numerals designate corresponding parts in the various figures. In one embodiment of the present patent application, the structural components illustrated herein are drawn to scale. It is to be expressly understood, however, that the drawings are for the purpose of illustration and description only and are not intended as a definition of the limits of the present patent application. It shall also be appreciated that the features of one embodiment disclosed herein can be used in other embodiments disclosed herein. As used in the specification and in the claims, the singular form of "a", "an", and "the" include plural referents unless the context clearly dictates otherwise. In addition, as used in the specification and the claims, the term "or" means "and/or" unless the context clearly dictates otherwise. It should also be appreciated that some of the components and features discussed herein may be discussed in connection with only one (singular) of such components, and that additional like components which may be disclosed herein may not be discussed in detail for the sake of reducing redundancy.

Other aspects, features, and advantages of the present patent application will become apparent from the following detailed description, the accompanying drawings, and the appended claims.

BRIEF DESCRIPTION OF THE DRAWINGS

Various embodiments are disclosed, by way of example only, with reference to the accompanying schematic drawings in which corresponding reference symbols indicate corresponding parts, in which

FIG. 4A-1, FIG. 4A-2, FIG. 4B-1, FIG. 4B-2, FIG. 4C-1 and FIG. 4C-2 show a generalized sequence of assembly for a wall system using internal frames in accordance with an embodiment of the present patent application;

FIG. 5 shows the clip system, and the clip system, before and after, mounting to the internal frame of the modular wall;

FIG. 6 shows the clip system, and the clip system after mounting to the internal frame of the modular wall;

FIG. 12 shows the clip system, and the clip system being mounting to the internal frame of the modular wall; FIG. 13 shows the clip system, and the clip system being mounting to the internal frame of the modular wall.

DETAILED DESCRIPTION OF THE DRAWINGS

Figure 1:
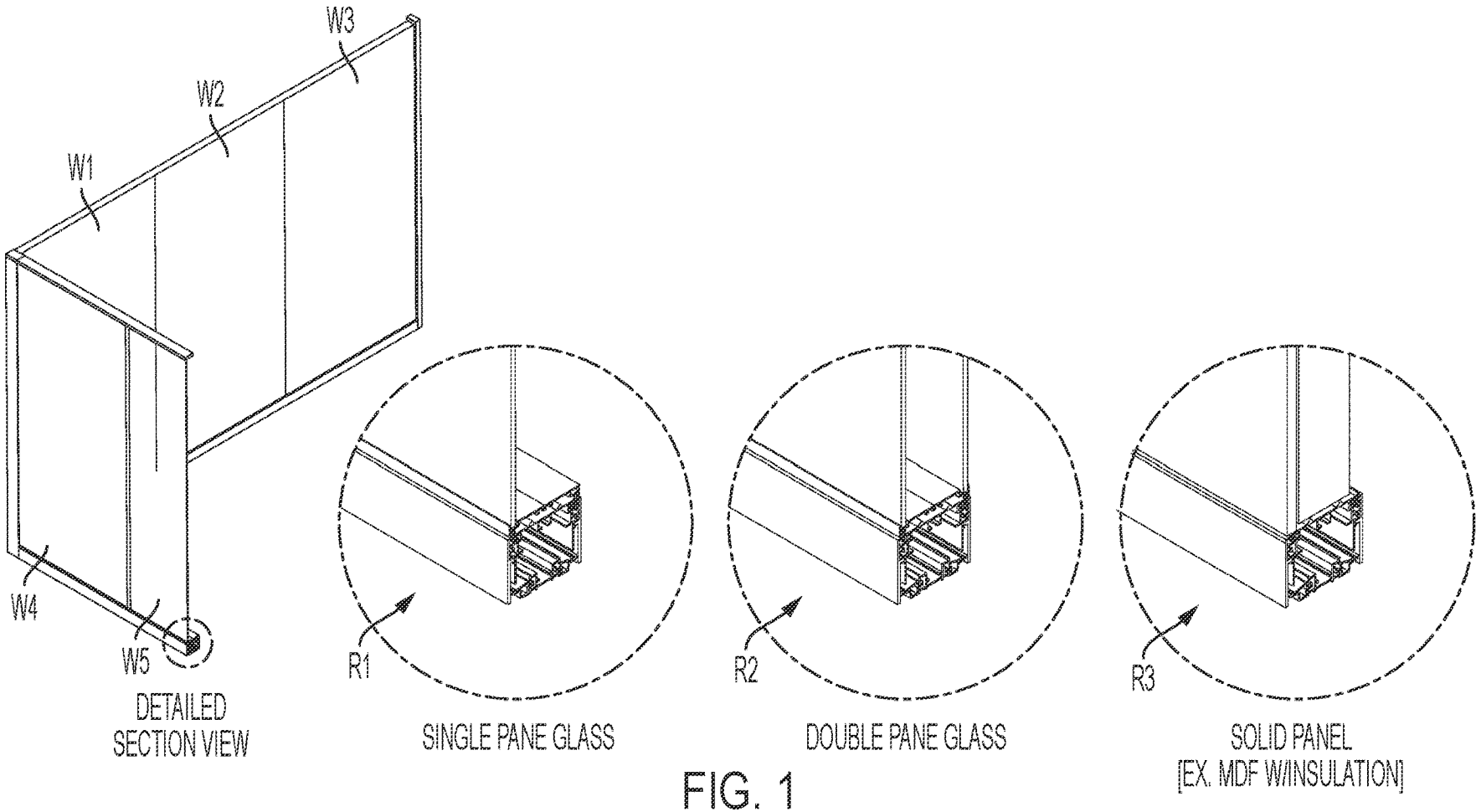
FIG. 1 shows an example of a partially constructed office space formed from modular walls where walls meet at corner and end-to-end junctions in accordance with an embodiment of the present patent application.

FIG. 1 shows an example of a partially constructed office space formed from modular walls formed of wall sections where walls meet at corner and end-to-end junctions. The space constructed need not be office related, and can be any setting, including residential, factory, educational, or otherwise. The office example is not limiting and is used for illustrative context.

Modular walls typically have a frame supporting panels of a variety of styles. Such panels may be wood, frameless glass (or another translucent or transparent material), back painted or frosted glass (or other translucent or transparent material), framed glass, gypsum, fiberboard, sheet metal, canvas exterior, etc. Any such panels can also be finished or covered with different treatments. Such panels can also be functional components, like a whiteboard, display screen, etc. The types of modular walls and panels thereof are not limiting and the examples mentioned herein are exemplary only.

In FIG. 1, for example, wall sections W1, W2 and W3 are shown meeting at end-to-end junctions, and wall sections W1 and W4 are shown meeting at a corner junction. A partial, cut-away wall section W5 also shown meeting wall section W4 at an end-to-end junction. The details of the end-to-end junctions and the corner junctions are discussed in detail in U.S. Patent Application Ser. No. 63/328,756 titled "Connecting Members And System For Modular Wall Junctions", which is incorporated by reference in their entirety. These patent applications are commonly owned by the same assignee as the present patent application.

Wall sections W1-W3 are shown as having wood, fiberboard or other non-transparent material, while wall sections W4 and W5 are glass wall sections.

FIG. 1 also shows a detailed view of different options for a bottom rail of wall sections W4 and W5, including a version R1 for mounting a single pane of glass, a version R2 for mounting two panes of glass, and a version R3 where the glass is replaced with one or more solid wood or fiberboard panels with acoustic dampening material (which may be used for wall sections W1-W3). The acoustic dampening material may be interchangeably referred to as insulation material. The acoustic dampening material may be positioned on both sides of the solid wood or fiberboard panel. The acoustic dampening material may be positioned between two solid wood or fiberboard panels. These examples are not limiting, and are provided simply to provide context of the types of wall sections that can be connected together using the features described herein below and the above-noted related patent applications.

Figure 2:
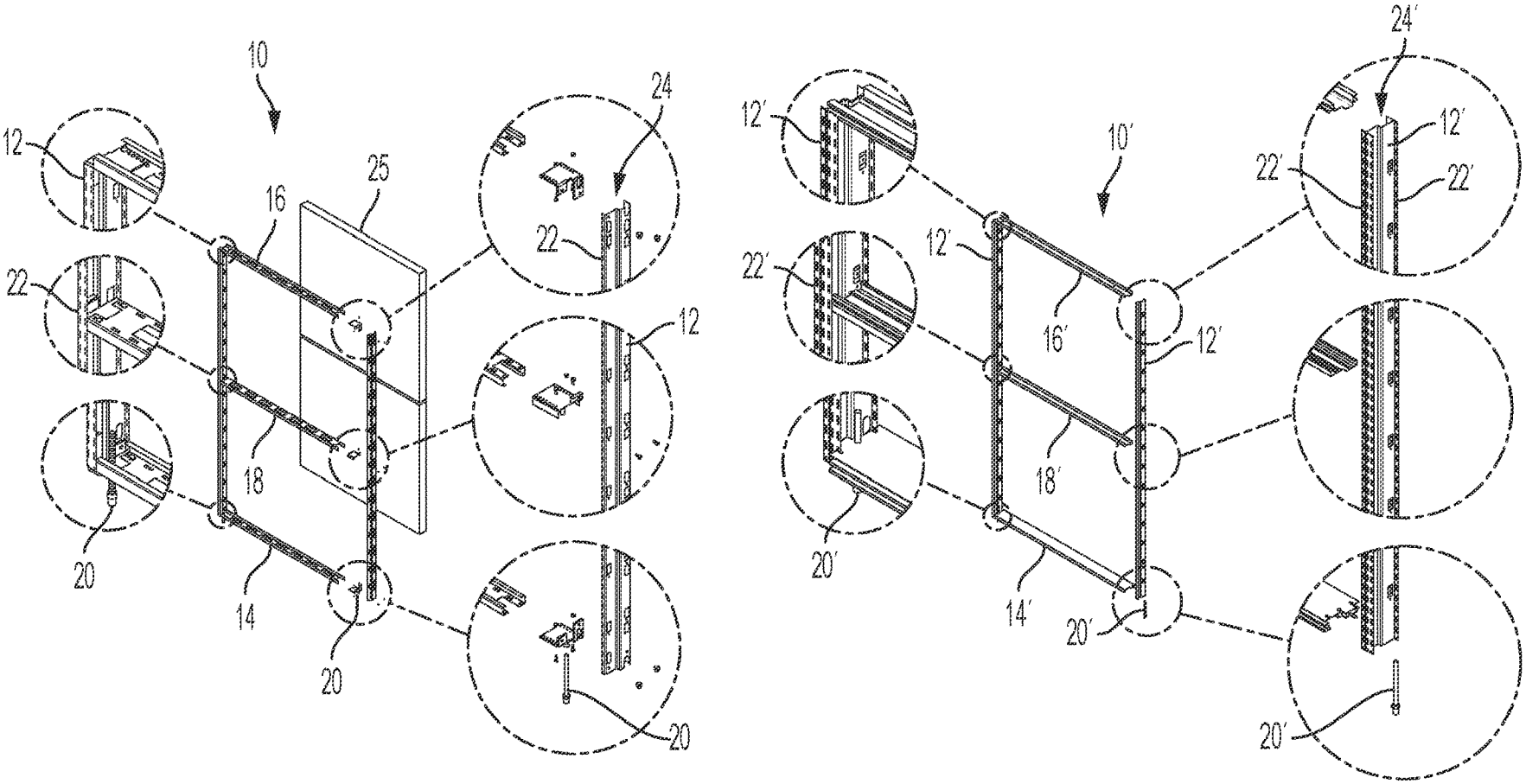
FIG. 2 shows perspective exploded views of exemplary internal frames for a modular wall section in accordance with an embodiment of the present patent application.

FIG. 2 shows examples of internal frame assemblies 10 and 10' used for mounting wall panels made of wood, fiberboard, gypsum, etc., or framed glass panels. The frame assembly may be interchangeably referred to as a frame or an internal frame. The frames are shipped pre-assembled and installed at the installation site (e.g., an office location). Corresponding parts for the second example 10' are denoted with a ' on the reference number. The frame 10, 10' generally includes a pair of vertical rail members 12, 12', a bottom rail 14, 14', a top rail 16, 16' and at least one intermediate horizontal rail 18, 18'. These rails are assembled together using any types of fasteners. The bottom rail 14 or vertical rail member 12' has a height adjuster 20, 20', respectively, that can be used to vertically adjust a height of the internal frame member 10, 10' to better match the ceiling and align components as needed.

The details of the bottom rail of the wall sections, the top rail of the wall sections, the height adjuster, and systems and methods of mounting the one or more panes of glass or solid wood/fiberboard panels to the bottom/top rail of the wall sections are discussed in detail in the above incorporated applications. The details of the bottom rail, the top rail, and the height adjuster are also discussed in detail in U.S. Patent Application Ser. No. 63/327,389 titled "Pre-assembled Internal Frame For Modular Wall Section", which is incorporated by reference in its entirety. This patent application is commonly owned by the same assignee as the present patent application.

The vertical frame members 12, 12' each have a series of vertically arranged openings 22, 22' for mounting wall panels 25 during installation of the wall section as will be described in detail below. These openings 22, 22' may also be used for mounting other accessories. The details of the accessories and mounting the accessories to the modular wall are discussed in detail in the above incorporated applications. The vertical frame members 12, 12' may also have a stepped configuration 24, 24' as discussed in detail in those applications.

The frame 10 may also include a plurality of horizontal frame members, e.g., 14, 16, 18, extending laterally between the vertical frame members 12 to connect the vertical frame members together, typically in parallel relation. Any horizontal frame members may be used, and those illustrated are not intended to be limiting. Typically, the plurality of horizontal frame members includes at least one intermediate horizontal frame member (e.g., 18) spaced vertically from the top and bottom of the frame. The frame's horizontal frame members may include a bottom horizontal frame member 14 and/or a top horizontal frame member 16. These frame members may also have any construction or configuration. These may be connected differently or in the same manner.

FIGS. 3A-3D show an example of a vertical frame member, which will be numbered 12 for convenience (and which could be any vertical frame member, and is only provided for context).

Figure 3A:
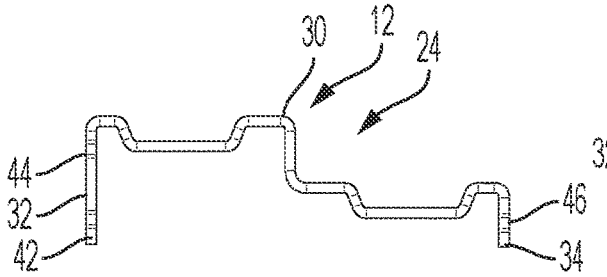
FIGS. 3A and 3B show a cross-sectional view of a vertical frame member and an end view of a pair of such vertical frame members from adjacent wall sections featured together in accordance with an embodiment of the present patent application.
Figure 3B:
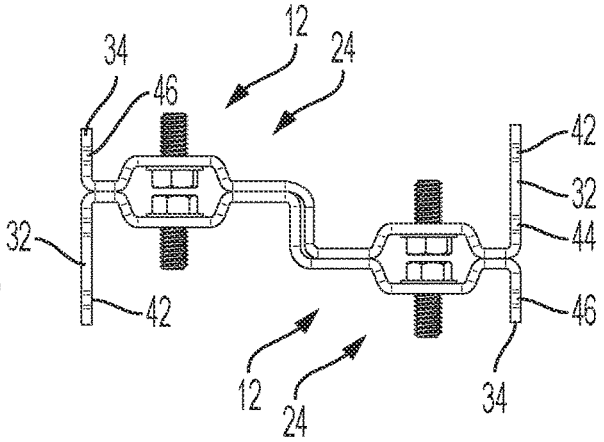
Figure 3C:
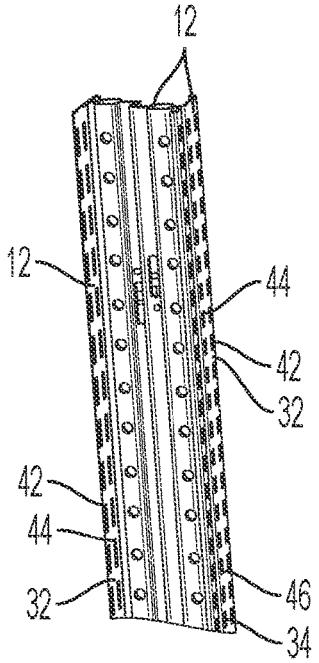
FIGS. 3C and 3D show various views of a pair of vertical frame members from adjacent wall sections in accordance with an embodiment of the present patent application.

The vertical frame member 12 in FIGS. 3A-3D is included in an internal frame for a modular wall section, which has a pair of the frame members 12 at the opposing ends thereof. Each vertical frame member 12 has a central web 30 extending in a depth direction of the frame (i.e.. to the right-left in FIGS. 3A-3B, which is the depth or thickness direction of the finalized wall section). The central web section 30 extends between a first flange 32 and a second flange 34. Each of the first and second flanges 32, 34 extends laterally inwardly from the central web 30. Here, laterally inwardly refers to inwardly in the lateral direction of the wall section. FIG. 3B shows the vertical frame members 12 of two different wall sections abutting in end-to-end relation, and the flanges 32, 34 of each extends laterally inwardly with respect to its associated wall section. Each first flange 32 has a pair of series of vertically arranged mounting openings 42, 44, and each second flange 34 has a single series of vertically arranged mounting openings 46.

The details of the vertical frame members, their manufacturing procedures, their stepped configurations, and an inverted relationship between the pair of vertical frame members (e.g., the vertical frame member at the left side of one wall section (e.g., the top one of the two) is inverted with respect to the vertical frame member at the right side of an adjacent wall section (e.g., the bottom one of the two) as shown in FIG. 3B) are discussed in detail in the application incorporated above. That application also discloses in detail how the inverted arrangement of the frame members in the same frame enables the frame to be arranged in an end to end junction with another frame with adjacent vertical frame members thereof abutting, for example, as shown in FIG. 3B and also how the frame, which is arranged in an end to end junction with another frame, is connected to another frame. That application further discloses in detail how the horizontal frame member(s) may be fastened to the vertical frame members 12.

Figures 1, 4A:
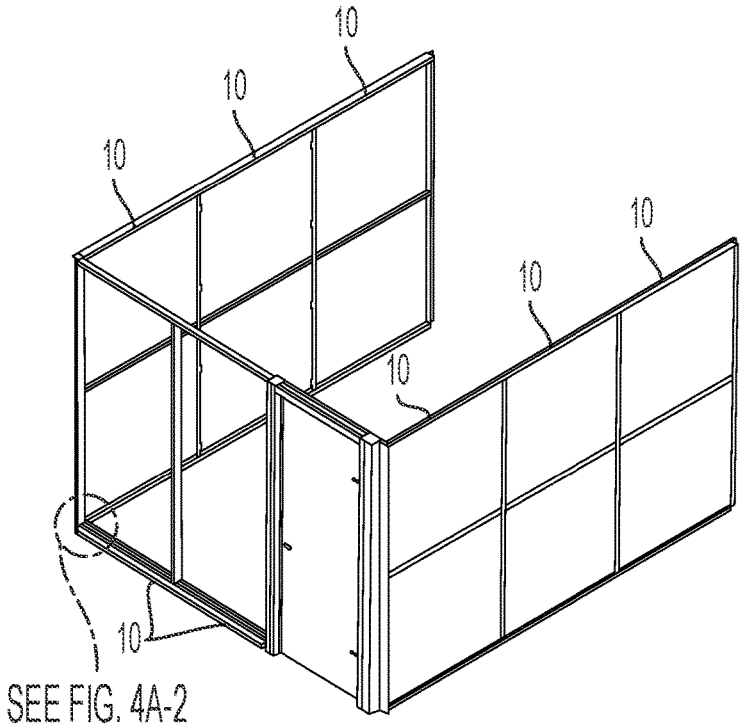
Figures 2, 4A:
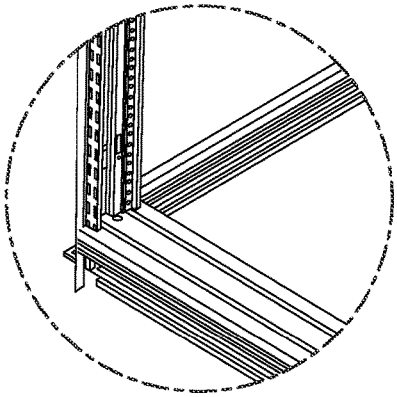
Figures 1, 4B:
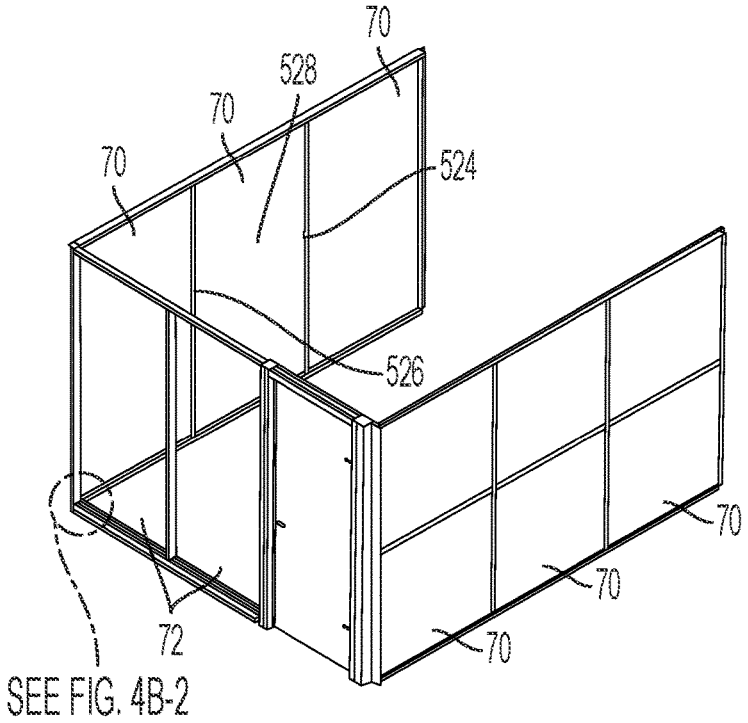
Figures 2, 4B:
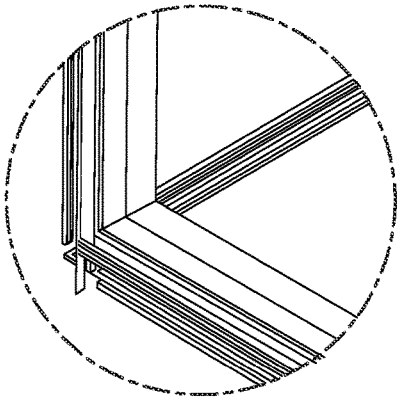
Figures 1, 4C:
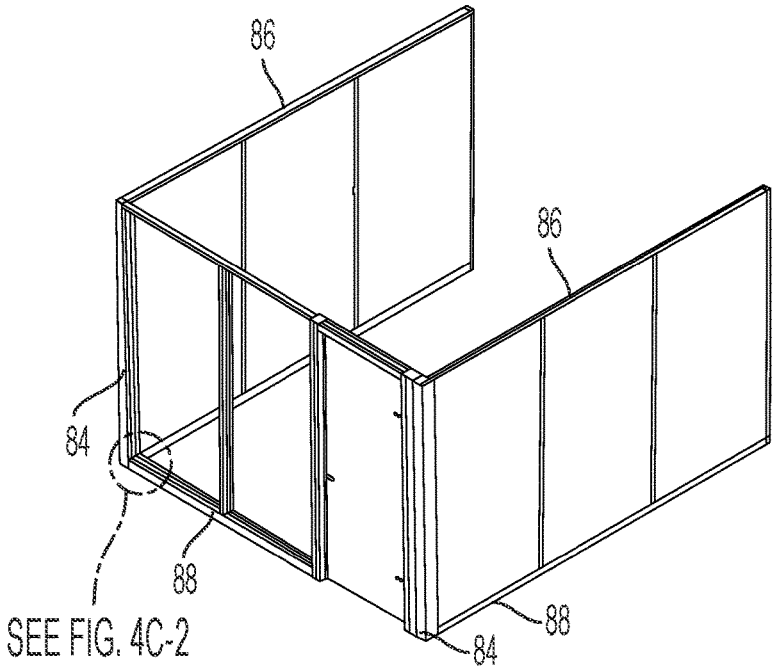
Figures 2, 4C:
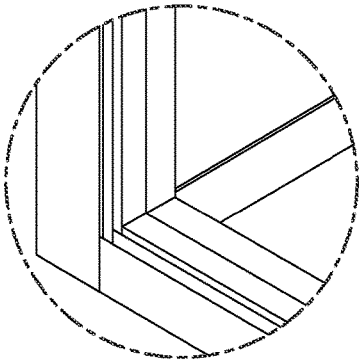

FIGS. 4A-4C illustrate the basic installation sequence of the modular wall in a generalized manner for non-limiting, explanatory context. FIG. 4A shows the internal frames 10 being installed to create a general office space.

Figure 3D:
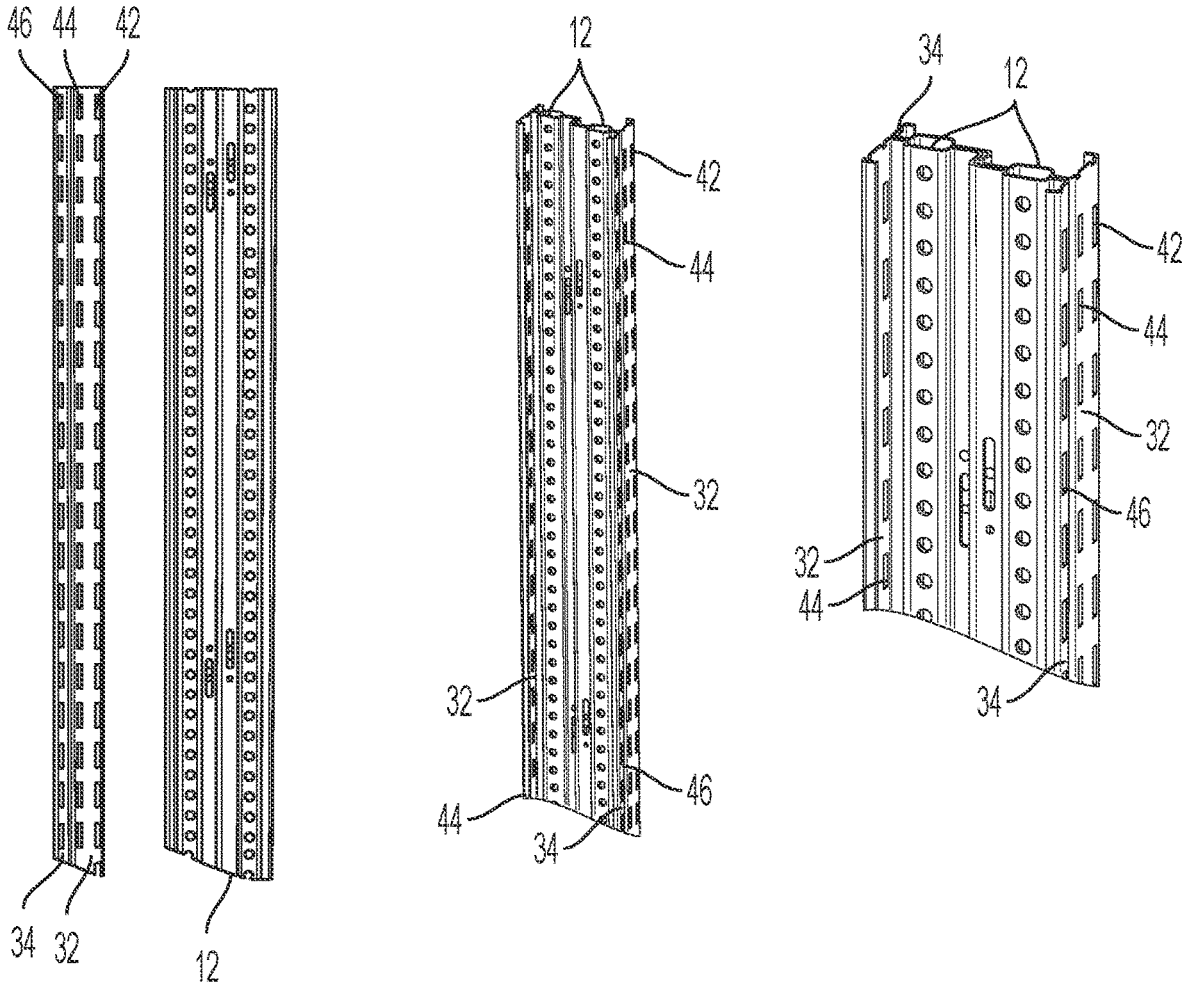

FIGS. 2-3D show the pre-assembled internal frames 10 that are made at a manufacturing location rather than at the installation site. The pre-assembled internal frames are delivered pre-assembled, at the installation site, without the wall panels mounted thereto. The installation of the modular wall by positioning a plurality of pre-assembled internal frames 10 is described in detail in the application incorporated above. As shown in FIG. 4A, the side walls may have acoustic dampening material in the pre-assembled frames 10 of the wall sections and the front wall sections having no acoustic dampening materials, as they will receive glass panels.

Alternatively, in another embodiment, the internal frame may be assembled at the installation site. That is, the internal frame may not be pre-assembled at the manufacturing location but rather assembled at the installation site.

In one embodiment, the internal frame, as used in the discussion below, may include either pre-assembled internal frame that is assembled at the manufacturing location and as shown in FIGS. 2-3D or internal frame that is assembled at the installation site.

The vertical frame members, the horizontal frame members, the height adjusters, the fasteners, and/or other components of the internal frame may have the same configuration as those in the pre-assembled internal frame. The vertical frame members, the horizontal frame members, the height adjusters, the fasteners, and/or other components of the internal frame may have different configurations than those in the pre-assembled internal frame.

In the illustrated non-limiting embodiment, each adjacent pair of the first and second flanges 32, 34 of the abutting vertical frame members 12 are positioned adjacent one another to provide three of the series of vertically arranged openings 42, 44, 46 on each side of the modular wall at the corresponding end to end junction of the adjacent wall sections.

FIG. 4B shows wall panels 70 may be mounted to the opposing faces of the internal frames 10. The wall panels 70 on the wall sections of the side walls are wood, fiberboard, canvas or textile covered sections, or the like, while the panels for the front wall sections are framed glass panels 72. These are non-limiting examples. As further examples, a panel may also be or include a functional component, and such as an electronic display (e.g., a display screen), a regular or interactive electronic whiteboard, chalkboard or the like, as mentioned above.

FIGS. 5-13 disclose various methods and systems for mounting wall panel 70, 72 to the internal frame (e.g., pre-assembled at the manufacturing location as shown in FIGS. 2-3D or assembled at the installation site) of the modular wall.

After the wall panels 70, 72 are installed, the wall system can be completed with the addition of fascia trim members. In FIG. 4C, this is illustrated by the addition of corner trim members 84 at the corner junctions between the front and side wall sections 70, 72, top trim members 86 extending horizontally along the top frame members, and bottom trim members 88 extending horizontally along the bottom frame members. These trim members can match the extent of an individual wall section or can be extend over the course of two or more wall sections. The particular trim members used and how they are mounted is not intended to be limiting, and any type of trim member may be used. Trim members where the wall sections meet at an end-to-end junction are described in detail in the above incorporated application.

Figure 5:
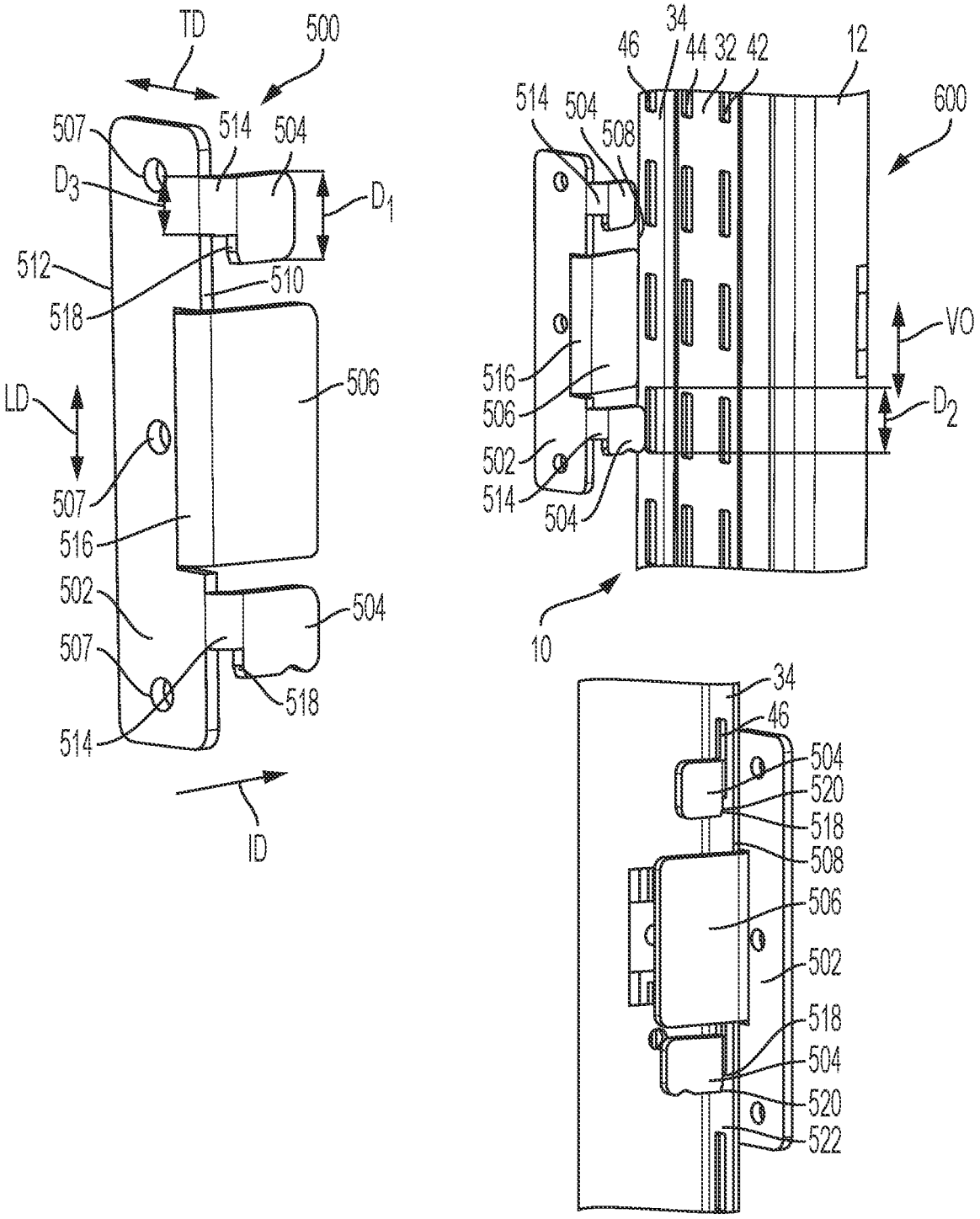
FIG. 5 shows an exemplary clip system for mounting a panel to an internal frame of a modular wall in accordance with an embodiment of the present patent application, where

FIG. 5 shows an exemplary clip 500 for mounting the panel (e.g., 70, 72) to the internal frame 10 of the modular wall. FIG. 5 also shows the clip 500, before and after, mounting to the internal frame of the modular wall.

The frame or internal frame 10 may include the vertical frame members 12 with the plurality of vertically arranged mounting openings 42, 46. That is, the plurality of vertically arranged mounting openings may include a first plurality of vertically arranged mounting openings 42 or 46 and a second plurality of vertically arranged mounting openings 42 or 46. The first plurality of vertically arranged mounting openings and the second plurality of vertically arranged mounting openings may be laterally spart from each other.

As discussed in detail above, the vertical frame member at the left side of one wall section/internal frame may have one of the first and second plurality of vertically arranged mounting openings 42, 46 and the vertical frame member at the right side of the wall section/internal frame may have the other of the first and second plurality of vertically arranged mounting openings 42, 46. One of the first and second plurality of vertically arranged mounting openings 42, 46 may be formed/disposed on the flange 32 of the left/right side vertical frame member, while the other of the first and second plurality of vertically arranged mounting openings 42, 46 may be formed/disposed on the flange 34 of the right/left vertical frame member.

The clip 500 is shown in FIG. 5 as being engaged with the plurality of vertically arranged mounting openings 46 formed/disposed on the flange 34 of the vertical frame member 12. On the opposing lateral edge of the internal frame 10, the clip(s) 500 may engage with the plurality of vertically arranged mounting openings 42 formed/disposed on the flange 32 of the vertical frame member 12. Although the flange 32 of the vertical frame member 12 may have two openings 42, 44, the clip(s) 500 may engage with the plurality of vertically arranged mounting openings 42 of the flange 32.

Each clip 500 may have a one-piece configuration. The clip 500 may include a mounting portion 502 for attaching the clip 500 to the panel 70, 72, a mounting insert 504 for insertion into one of the mounting opening 42, 46 on one of the vertical frame members 12, and an alignment member 506, each of which will be described in detail below. The mounting insert 504, the mounting portion 502 and the alignment member 506 may all be integrally formed as one continuous piece.

The mounting portion 502 may include openings 507 (three are shown but the number can vary) that are configured to receive fasteners therein to attach the clip 500 to an inner face 528 (as shown in FIG. 4B) of the panel 70, 72. The mounting portion 502 may generally extend (e.g., laterally and longitudinally) in a plane that is parallel to the plane of the panel 70, 72. The mounting portion 502 may have an elongated shaped configuration. The mounting portion 502 may be attached on the inner face 528 (as shown in FIG. 4B) of the panel 70, 72 near one of the lateral edges of the panel 70, 72.

As would be appreciated by a person skilled in the art, the panel 70, 72 may have opposing two lateral edges. The clips 500 may be attached along both the lateral edges of the panel 70, 72 so as to correspond to the two vertical frame members 12 of the frame 10 and to engage with the openings 42, 46 of the two vertical frame members 12 of the frame 10. The clips 500 may be attached spaced apart from each other along each lateral edge of the panel 70, 72. The number of clips 500 being attached along each lateral edge of the panel 700, 72 may depend on the longitudinal dimension of the panel 70, 72 and may also depend on the material (e.g., weight) of the panel 70, 72 being mounted to the internal frame 10 of the modular wall.

Each wall panel 70, 72 may have a plurality of clips 500 disposed on/mounted to the inner face 528 (as shown in FIG. 4B) thereof and at opposing lateral edges 524, 526 (also shown in FIG. 4B) thereof. The clips 500 disposed on/mounted to the opposing lateral edges 524, 526 of the panel may have inverted/mirror configurations such that the mounting inserts 504 extend outwardly from the inner face 528 of the panel and disposed at the opposing lateral edges 524, 526 (as shown in FIG. 4B) of the panel.

The mounting insert 504 of the clip 500 may extend in an insertion direction ID for insertion into one of the mounting opening 42, 46 on one of the vertical frame members 12 with a longitudinal direction LD of the clip 500 aligned in the vertical direction VD of the vertical frame member 12. In the illustrated embodiment, the mounting insert 504 may include two mounting inserts that are spaced part along the longitudinal direction LD of the clip 500. The number of mounting inserts 504 on the clip 500 may vary. The two mounting inserts 504 may be spaced apart such that they align with the corresponding mounting openings 42, 46 on one of the vertical frame members 12 into which the mounting inserts 504 are being received. The mounting insert 504 may be positioned on one 510 of the two opposing lateral edges 510, 512 of the mounting portion 502/clip 500.

The mounting insert 504 may have a dimension D1, along the longitudinal direction LD of the clip 500. The dimension D1 of the clip 500 may be smaller than a dimension D2, along the vertical direction VD, of the corresponding opening 42, 44 of the vertical frame member 12 so as to allow the insertion of the mounting insert 504 into the corresponding opening 42, 44 of the vertical frame member 12.

The alignment member 506 of the clip 500 may be offset from the mounting insert 504 in a lateral direction TD of the clip 500. The alignment member 506 may have a plate configuration extending in the longitudinal direction LD of the clip 500 and in the insertion direction ID. The insertion direction ID may be perpendicular to both the longitudinal direction LD of the clip 500 and the lateral direction TD of the clip 500. The mounting insert 504 and the alignment member 506 of the clip 500 may be perpendicular to the mounting portion 502 of the clip 500.

The mounting insert 504 may be disposed in a first plane of the clip 500 and the alignment member 506 may be disposed in a second plane of the clip 500 laterally spaced from the first (e.g., in the TD direction). The alignment member 506 may also be interchangeably referred to as a locator. The first and the second planes of the clip 500 may be parallel to each other. The first and the second planes of the clip 500 may be perpendicular to the plane of the mounting portion 502. The first plane of the clip 500 passes through the mounting inserts 504 and thus aligns with the mounting openings 42, 46 when receiving the mounting inserts 504, while the second plane may be positioned adjacent a vertical edge 508 of the vertical frame member 12 when the mounting inserts 504 are received by the corresponding mounting openings 42, 46. The alignment member 506 may be positioned closer to the lateral edge 510 of the mounting portion 502/clip 500 than the mounting insert 504.

The clip 500 may also include an attachment portion 516 that is configured attach the alignment member 506 to the mounting portion 502. The attachment portion 516 may be configured to facilitate transition between (the plane of) the mounting portion 502 and (the plane of) the alignment member 506. The alignment member 506 may extend further in the insertion direction ID than the mounting insert 504. The alignment member 506 may be configured such that contact of the alignment member 506 with the vertical edge 508 of the vertical frame member 12 aligns the mounting insert 504 in the lateral direction TD with the corresponding mounting opening 42, 46 for insertion therein.

The clip 500 may also include an attachment portion 514 that is configured attach the mounting insert 504 to the mounting portion 502. The attachment portion 514 may be configured to facilitate transition between (the plane of) the mounting portion 502 and (the plane of) the mounting insert 504. The attachment portion 514 may extend partially along the mounting insert 504 and may have a dimension D3 that is less than the dimension D1 of the mounting insert 504. This configuration may enable a portion 518 of the mounting insert 504 to engage with a portion 520 of an inner face 522 of the flange 34 when the mounting insert 504 is received in the corresponding opening 42, 44 of the vertical frame member 12. The engagement between the portion 518 of the mounting insert 504 and the portion 520 of the inner face 522 of the flange 34 secures the clip 500 to the vertical frame member 12 of the internal frame 10 and prevents the clip 500 (and the panel 70, 72 attached thereto) from being detached/ disengaged from the vertical frame member 12. In addition to this engagement, the engagement of the alignment member 506 with vertical edge 508 of the vertical frame member 12 may further secure the clip 500 with respect to the vertical frame member 12 and may prevent any movement/pivoting of the clip 500 with respect to the vertical frame member 12.

The present patent application also provides a method 600 of mounting the panel 70, 72 to at least two vertical frame members 12 of the internal frame 10 of the modular wall. The method 600 may comprise positioning the panel 70, 72 adjacent the vertical frame members 12. Although the panel 70, 72 is not shown in FIG. 5, as would be appreciated by a person of ordinary skill in the art, the mounting portions 502 of the clip 500 are attached to the inner faces of the panel 70, 72. The method 600 may also include inserting the mounting insert 504 of each clip 500 into a corresponding mounting opening 42, 46 of the vertical frame member 12. This inserting procedure of the method 600 may also include contacting the alignment members 506 of the clips 500 with the vertical edges 508 of the vertical frame members 12 to align each mounting insert 504 in the lateral direction TD of the clip 500 with its corresponding mounting opening 42, 46 during the insertion.

Figure 6:
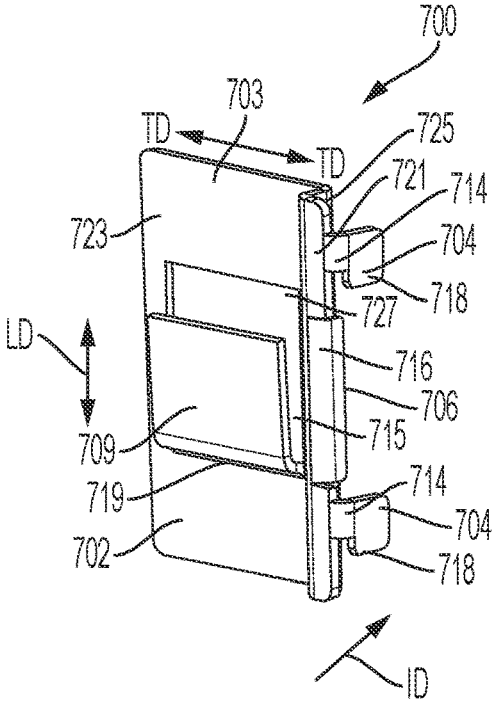
FIG. 6 shows an exemplary clip system for mounting a panel to an internal frame of a modular wall in accordance with another embodiment of the present patent application, where
Figure 6:
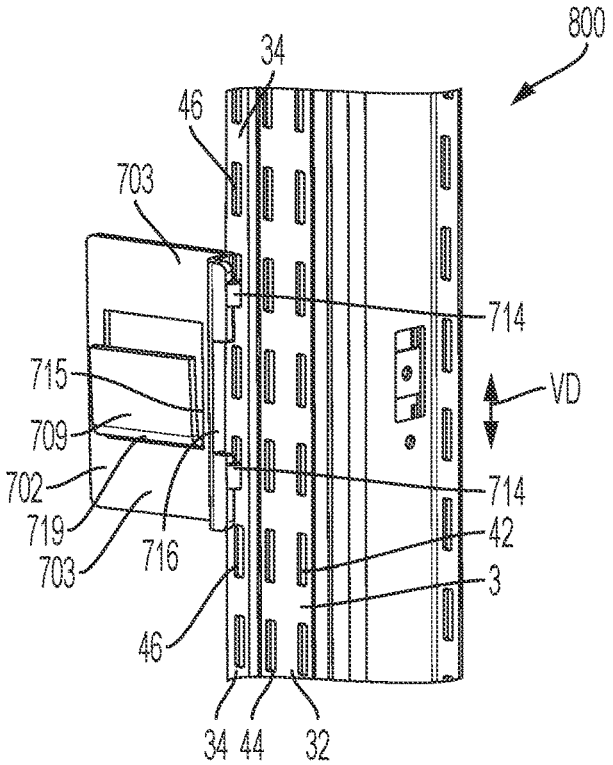
Figure 6:
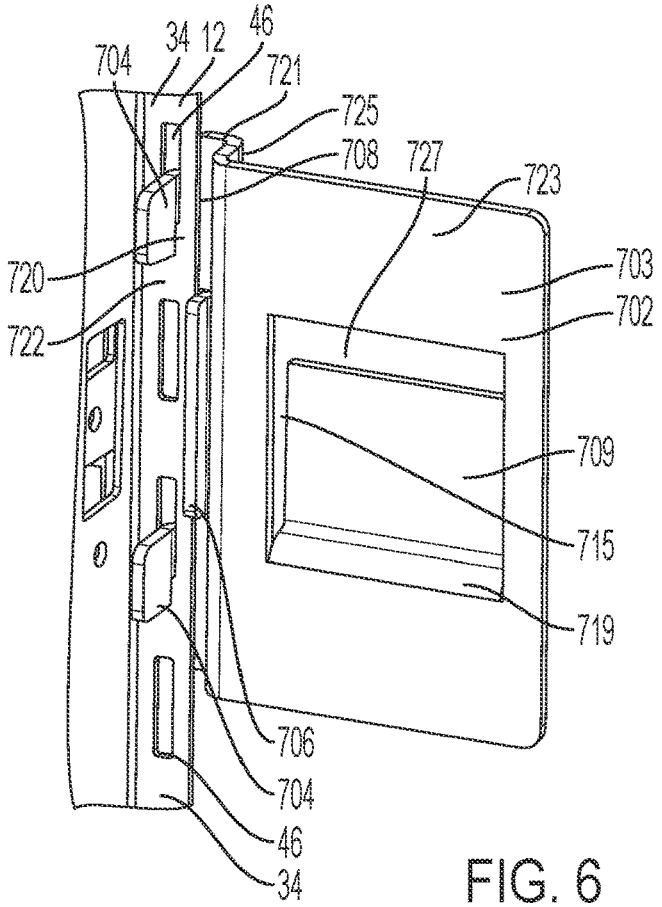
Figure 7:
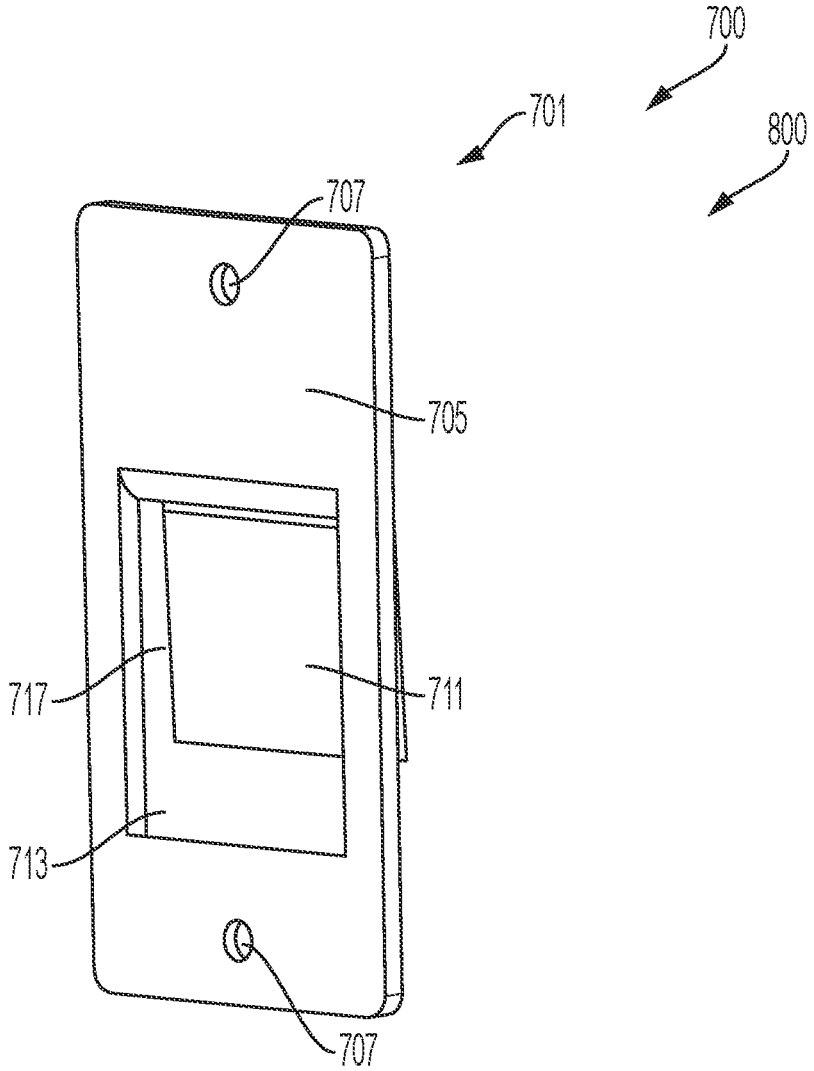
FIG. 7 shows an exemplary frame clip of the clip system of FIG. 6, the frame clip being configured for mounting to the panel and for engaging with the panel clip of the clip system of FIG. 6 for mounting the panel to the internal frame of the modular wall in accordance with an embodiment of the present patent application.
Figure 8:
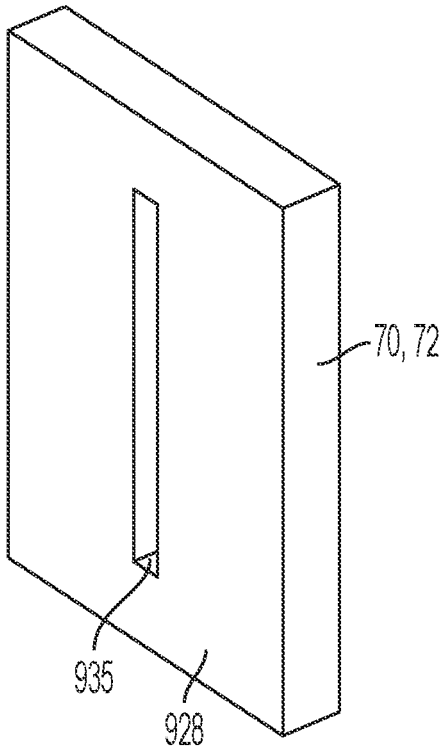
FIG. 8 shows an exemplary portion of a panel having one of vertically arranged slots therein in accordance with an embodiment of the present patent application.

FIGS. 6 and 7 show another exemplary clip system 700 for mounting the panel 70, 72 to the internal frame 10 of the modular wall. As will be clear from the discussion below, the clip system 700 may include a French cleat design/configuration. FIG. 6 also shows the clip system 700 after mounting to the internal frame 10 of the modular wall. The frame or internal frame 10 that includes the vertical frame members 12 with the plurality of vertically arranged mounting openings 42, 46 therein is described in detail with respect to FIG. 5, and, therefore, will not be described here with respect to FIG. 6.

Referring to FIGS. 6 and 7, the clip system 700 may include a panel clip 701 and a frame clip 703. That is, unlike the clip 500 in FIG. 5, the clip system 700 includes a two piece construction, for example, with the panel clip 701 and the frame clip 703.

The panel clip 701 is shown in FIG. 7. The panel clip 701 may comprise a panel clip body 705 for mounting to the panel 70, 72 and a mounting projection 711 extending from the panel clip body 705 to project downwardly during mounting of the panel 70, 72. The panel clip 701 may have one piece construction. That is, the panel clip body 705 and the mounting projection 711 of the panel clip 701 may be integrally formed. The panel clip 701 may be made of metal, plastic, composite and/or other materials. The mounting projection 711 optionally has a plate-like configuration.

The panel clip body 705 may include openings 707 that are configured to receive fasteners therein to attach the panel clip 701 to the inner face 528 of the panel 70, 72. Two openings 707, one at the top portion and one at the bottom portion of the panel clip body 705, are shown in FIG. 7 but the number of openings can vary.

The panel clip body 705 may generally extend (e.g., laterally and longitudinally) in a plane that is parallel to the plane of the panel when the panel clip body 705 is attached to the panel 70, 72. The panel clip body 705 may have an elongated shaped configuration. The panel clip body 705 may include an opening 713 therein to receive portions of a panel support projection 709 of the frame clip 703 therein when the panel clip 701 is engaged with the frame clip 703. The opening 713 may be optional.

The mounting projection 711 may extend in a plane that is generally parallel to and spaced apart from the plane of the panel clip body 705. The spacing 717 between the (plane of) panel clip body 705 and the (plane of) the mounting projection 711 may be configured to receive and accommodate a portion (i.e., the panel support projection) 709 of the frame clip 703 therein when the panel clip 701 is engaged with the frame clip 703.

The panel clip 701 may also include an attachment portion that may be configured to enable the attachment of the mounting projection 711 to the panel clip body 705, which may also facilitate transition between the plane of the panel clip body 705 and the plane of the mounting projection 711. The attachment portion may also be configured to facilitate the mounting projection 711 being spaced apart from the panel clip body 705 so as to form the downwardly facing spacing, pocket or receiving portion 717 between the mounting projection 711 and the panel clip body 705. As noted above, the spacing, pocket or receiving portion 717 of the panel clip 701 may be configured to receive and accommodate the panel support projection 709 of the frame clip 703 when the panel clip 701 is engaged with the frame clip 703.

In the illustrated embodiment, the clip system 700 may include hook type attachment elements (e.g., the mounting projection 711 of the panel clip 701 and the panel support projection 709 of the frame clip 703). In another embodiment, the clip system 700 may include other types of attachment elements, as would be appreciate by a person of ordinary skill in the art, that may be configured to mount the panel to the internal frame of the modular wall.

Referring to FIG. 6, the frame clip 703 may comprise a frame clip body 702, at least two mounting inserts 704 extending from the body 702 in the insertion direction ID, and a panel support projection 709. The frame clip 703 may have one piece construction. That is, the frame clip body 702, the at least two mounting inserts 704, and the panel support projection 709 of the frame clip 703 may all be integrally formed as a continuous piece.

The frame clip body 702 may generally extend (e.g., laterally and longitudinally) in a plane that is parallel to and spaced apart from the plane of the panel. The frame clip body 702 may have an elongated shaped configuration.

The mounting inserts 704 are spaced apart from one another in the longitudinal direction LD of the frame clip 703 for insertion into respective mounting openings 42, 46 on one of the vertical frame members 12 with the longitudinal direction LD of the frame clip 703 aligned in the vertical direction VD of the vertical frame member 12. The mounting inserts 704 may have similar configuration as the mounting inserts 504 in FIG. 5, and, therefore, will not be described here with respect to FIG. 6.

The panel support projection 709 may be configured to extend from the frame clip body 702 opposite the mounting inserts 704 to provide a receiving space 715 that faces upwardly when the frame clip 703 is mounted to the vertical frame member 12 to receive the mounting projection 711 of the panel clip 701 for supporting the panel.

The frame clip body 702 may include a first portion 721, a second portion 723 and a transition portion 725 therebetween. The first portion 721 and the second portion 723 may be positioned (in separate planes) parallel to each other and spaced apart from each other. The transition portion 725 may be generally perpendicular to the first portion 721 and the second portion 723. The mounting inserts 704 may be attached to the first portion 721 and the panel support projection 709 may be attached to the second portion 723. This stepped down configuration (in the direction of the insertion direction ID) of the second portion 723 with respect to the first portion 721 enables the panel support projection 709 to extend from the frame clip body 702 (opposite the mounting inserts 704) to provide the receiving space 715 between the panel support projection 709 and the frame clip body 702 for the mounting projection 711 of the panel clip 701 and yet enable the panel 70, 72 to be flush or closer to flush with the vertical frame members 12 of the internal frame when the panel 70, 72 is mounted to the internal frame of the modular wall.

The frame clip body 702 may include an opening 727 therein to receive portions of the mounting projection 711 of the panel clip 701 therein when the panel clip 701 is engaged with the frame clip 703. The opening 727 may be optional.

The clip system 700 may include an alignment member 706 that is offset from the mounting insert 704 in a lateral direction TD of the clip system 700. The alignment member 706 may have a plate configuration extending in the longitudinal direction LD of the clip system 700 and in the insertion direction ID. The alignment member 706 may have the same configuration as the alignment member 506 described in detail with respect to FIG. 5, except for the differences noted here.

The alignment member 706 may extend further in the insertion direction ID than the mounting inserts 704, however, the dimension of the alignment member 706, in the insertion direction ID, is smaller than the dimension of the alignment member 506, in the insertion direction ID. Like the alignment member 506, the alignment member 706 is configured such that contact of the alignment member 706 with a vertical edge 708 of the vertical frame member 12 aligns the mounting insert 704 in the lateral direction TD with the corresponding mounting opening 42, 46 for insertion therein.

As discussed in detail with respect to FIG. 5, the engagement between portion 718 of the mounting insert 704 and portion 720 of an inner face 722 of the flange 34 may secure the frame clip 703 to the vertical frame member 12 of the internal frame 10 and prevent the frame clip 703 from being detached from the vertical frame member 12. In addition to this engagement, the engagement of the alignment member 706 with vertical edge 708 of the vertical frame member 12 may further secure the frame clip 703 with respect to the vertical frame member 12 and may prevent any movement/pivoting of the frame clip 703 with respect to the vertical frame member 12.

The panel support projection 709 may extend in a plane that is generally parallel to and spaced apart from the plane of the frame clip body 702. The spacing 715 between the plane of the frame clip body 702 and the plane of the panel support projection 709 may be configured to receive and accommodate the mounting projection 711 of the panel clip 701 therein when the panel clip 701 is engaged with the frame clip 703.

The frame clip 703 may also include an attachment portion 719 that may be configured to enable the attachment of the panel support projection 709 to the frame clip body 702, which may also facilitate transition between the plane of the frame clip body 702 and the plane of the panel support projection 709. The attachment portion 719 may also be configured to facilitate the panel support projection 709 being spaced apart from the frame clip body 702 so as to form the upwardly facing receiving space 715 between the panel support projection 709 and the frame clip body 702. As noted above, the receiving space 715 of the frame clip 703 may be configured to receive and accommodate the mounting projection 711 of the panel clip 701 when the panel clip 701 is engaged with the frame clip 703.

The present patent application also provides a method 800 of mounting the panel 70, 72 to at least two vertical frame members 12 of the internal frame 10 of the modular wall using the clip system 700. The method 800 comprises inserting the mounting inserts 704 of each frame clip 703 into respective mounting openings 42, 46 of the vertical frame member 12 with the receiving space 715 facing upwardly; positioning the panel 72, 74 adjacent the vertical frame members 12; and inserting the mounting projections 711 of the panel clips 701 into the receiving space 715 on the frame clips 703 to support the panel 72, 74 on the vertical frame members 12.

FIGS. 8-11 show a panel and clip system 900 for mounting the panel 70, 72 to the internal frame 10 of the modular wall. The frame or internal frame 10 that includes the vertical frame members 12 with the plurality of vertically arranged mounting openings 42, 46 therein is described in detail with respect to FIG. 5, and, therefore, will not be described here with respect to FIGS. 8-11.

The panel and clip system 900 includes the panel 70, 72, a plurality of clip supports 931, and a plurality of clips 933.

The panel 70, 72 may have at least a first series of two or more vertically arranged slots 935 and a second series of two or more vertically arranged slots 935 spaced laterally apart from the first series. The first series of two or more vertically arranged slots 935 and the second series of two or more vertically arranged slots 935 may be disposed on the inner surface 928 of the panel 70, 72. Only a portion of the panel 70, 72 with one of the first and the second series of two or more vertically arranged slots 935 is shown in FIGS. 8-11.

As would be appreciated by a person of ordinary skill in the art, the panel 70, 72 may have the first series of two or more vertically arranged slots 935 on one side/half and near a first lateral edge of the panel 70, 72 and may have the second series of two or more vertically arranged slots 935 on the other side/half and near opposing, second lateral edge of the panel 70, 72. In each of the first and the second series, the two or more vertically arranged slots 935 may be spaced apart from each other. The number of vertically arranged slots may depend on the longitudinal dimension of the panel 70, 72 and may depend on the material (e.g., weight) of the panel 70, 72. For example, if the panel 70, 72 has a shorter longitudinal dimension and/or is made of a lighter material, then the number of vertically arranged slots in each of the first and the second series may be less, and vice versa. Also, each vertically arranged slot in each of the first and the second series may correspond to one of the plurality of clips 933. Each vertically arranged slot in each of the first and the second series may also extend into the thickness of the panel 70, 72 so as to (e.g., completely) receive panel mounting insert(s) 951 (described in detail below) of the corresponding clip 933.

Figure 9:
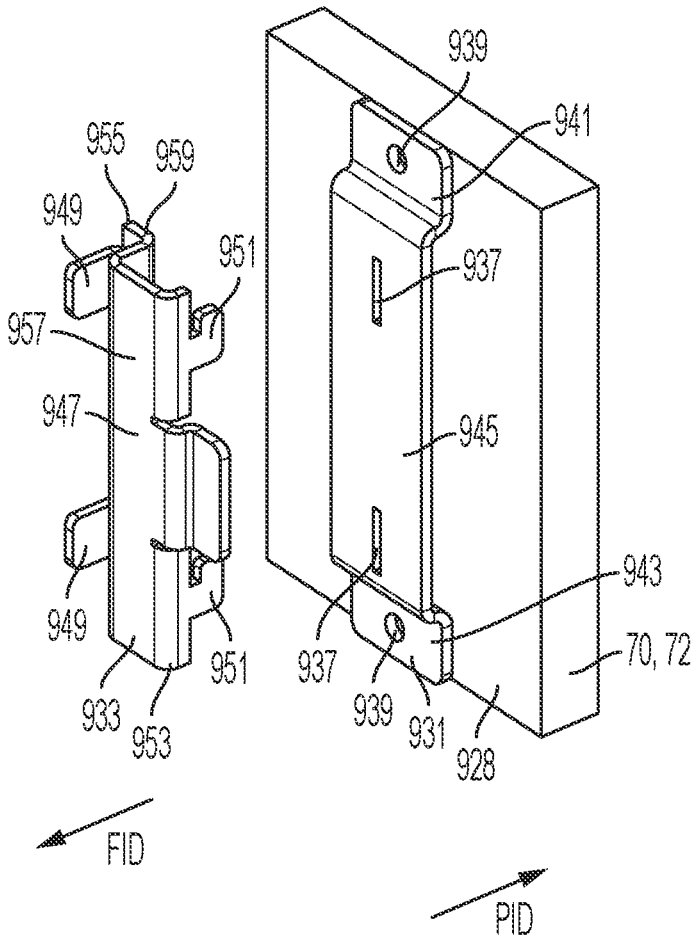
FIG. 9 shows the exemplary portion of the panel of FIG. 8 with a clip support attached thereto and an exemplary clip system for mounting the panel to the internal frame of the modular wall in accordance with an embodiment of the present patent application.

Unlike the clip 500 in FIG. 5 and similar to the clip system 700, the clip system 900 may include a two piece construction, for example, with the clip supports 931 and the clips 933. Each of the plurality of clip supports 931 may have at least one mounting opening 937 formed therethrough. Two mounting openings 937 are shown in FIG. 9, but the number may vary. The number of mounting openings 937 may correspond to the number of panel mounting inserts 951 of the clip 933.

Each clip support 931 may be attached to the panel 70, 72 such that each clip support 931 is positioned over a corresponding one of the vertically arranged slots 935 with the mounting opening 937 thereof aligned with the corresponding slot 935. The alignment of the mounting opening(s) 937 of the clip support 931 with the vertically arranged slot 935 of the panel 70, 72 enables the panel mounting insert(s) 951 of the clip 933 to pass through the mounting opening(s) 937 of the clip support 931 and to be (e.g., completely) received in the vertically arranged slot 935 of the panel 70, 72 when mounting the panel 70, 72 to the internal frame 12 of the modular wall. The use of the slots 935 on the panel 70, 72 reduces the amount (if any) the clip support 931 is spaced from the panel surface.

The clip support 931 may also include openings 939 that are configured to receive fasteners therein to attach the clip support 931 to the inner face 928 of the panel 70, 72. Two openings 939, one at the top portion and one at the bottom portion of the clip support 931, are shown in FIG. 9 but the number of openings can vary.

The clip support 931 may have one piece construction. The clip support 931 may include a first portion 941, a second portion 943 and a transition portion 945 therebetween. The first portion 941 and the second portion 943 may be positioned in the same plane but are spaced apart from each other. The transition portion 945 may be positioned in a different plane that is parallel to the plane of the first portion 941 and the second portion 943 such that the transition portion 945 protruded outwardly away from the panel 70, 72. The outwardly protruding configuration of the transition portion 945 enables the panel mounting insert(s) 951 of the clip 933 to be (e.g., completely) received in the vertically arranged slot 935 of the panel 70, 72 when mounting the panel 70, 72 to the internal frame 12 of the modular wall. The first portion 941 and the second portion 943 may have the fastener receiving openings 939 therein and the transition portion 945 may have the mounting openings 937 therein.

Each of the plurality of clips 933 may have a body 947, a frame mounting insert 949 extending from the body 947 in a frame insertion direction FID for insertion into a corresponding mounting opening 42, 46 on one of the vertical frame members 12, and a panel mounting insert 951 for extending in a panel insertion direction PID opposite the frame insertion direction FID for insertion into a corresponding mounting opening 937 on one of the clip supports 931 so as to extend into the corresponding vertically arranged slot 935 on the panel 70, 72.

The frame mounting inserts 949 may be positioned at one of the lateral edges 955 of the clip 933. The panel mounting inserts 951 may be positioned at the other of the lateral edges 953 of the clip 933. The panel mounting inserts 951 are spaced laterally from the frame mounting inserts 949 so that the panel 70, 72 can be flush up against the frame member 12. Also, the clip 933 may include a u-shaped configuration portion 957 and a stepped down configuration portion 959 between the laterally spaced apart the panel mounting inserts 951 and the frame mounting inserts 949. These portions 957 and 959 of the clip 933 may also enable the panel 70, 72 to be flush up against the frame member 12.

Figure 10:
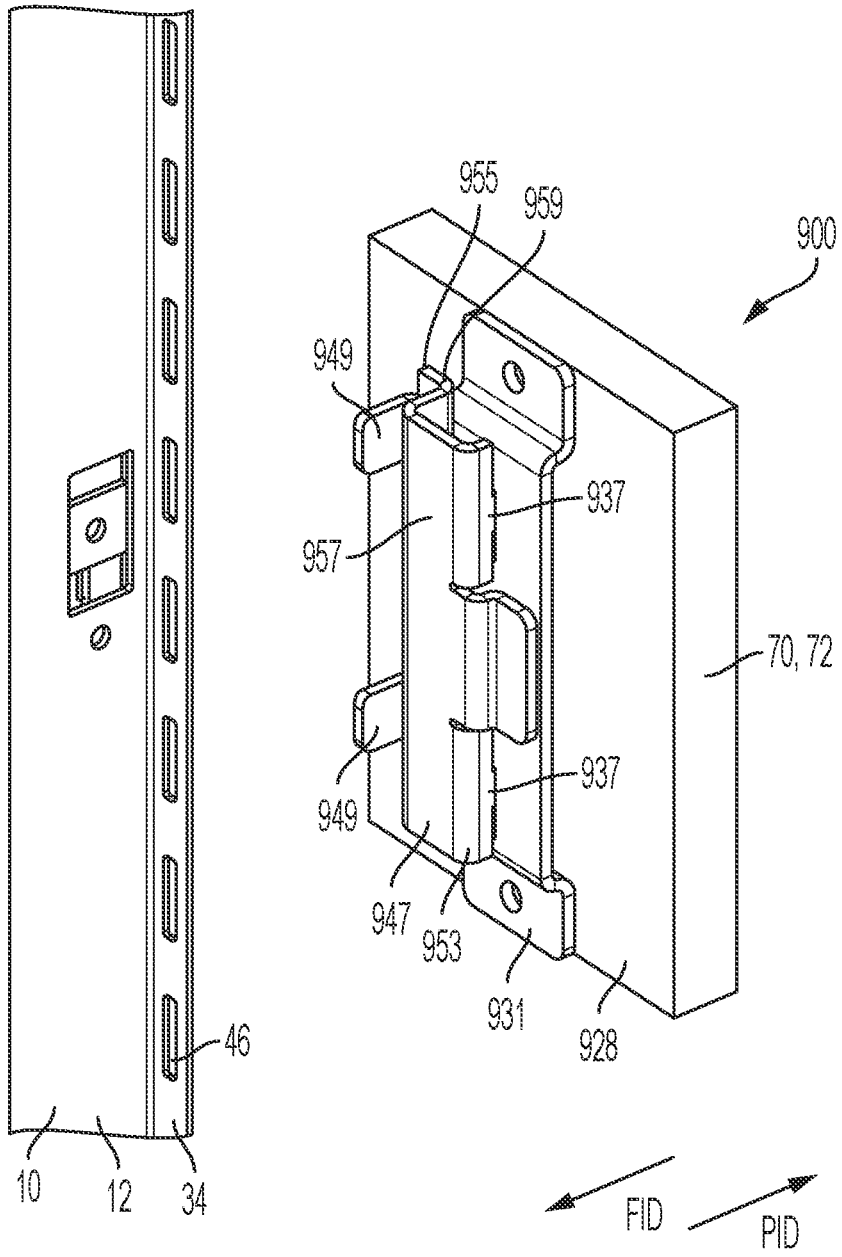
FIGS. 10 and 11 show the clip system and the panel of FIG. 9 before and after mounting the panel to the internal frame of the modular wall in accordance with an embodiment of the present patent application.
Figure 11:
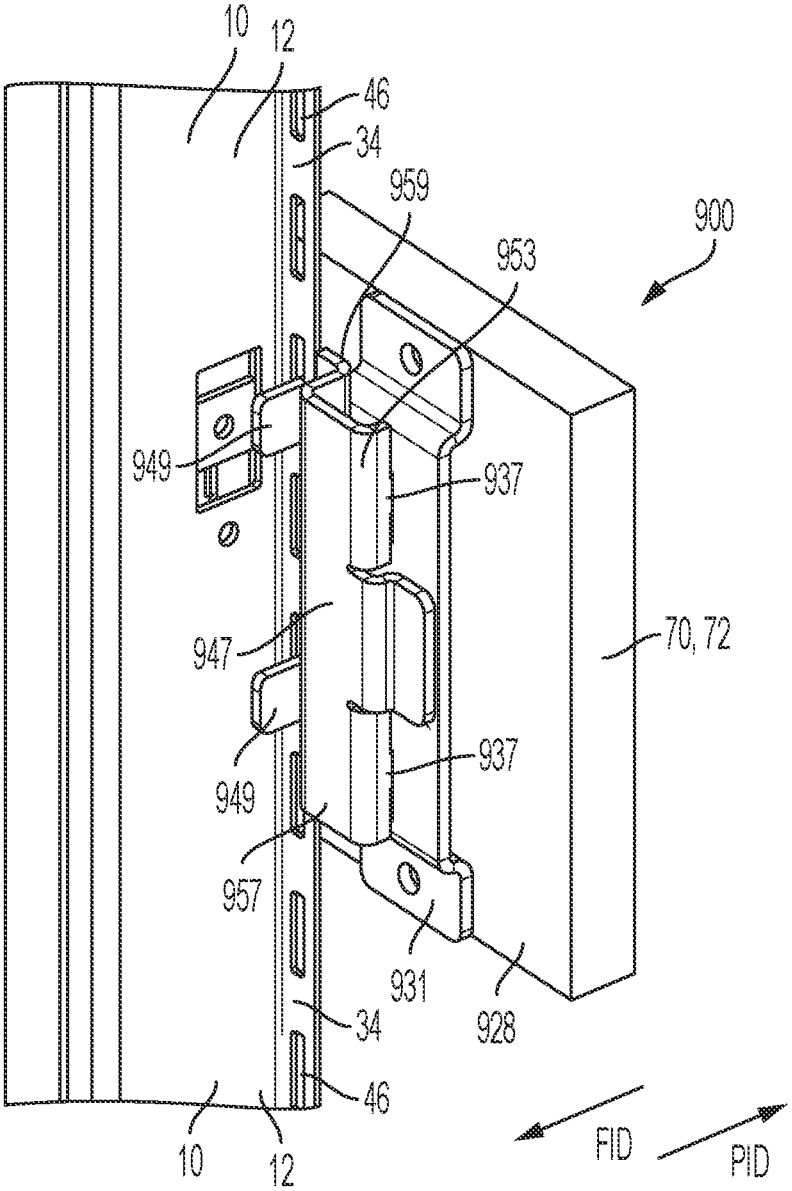

A method 1000 of mounting the panel 70, 72 to at least two vertical frame members 12 of the internal frame 10 of the modular wall using the panel and clip system 900 is provided. As shown in FIGS. 9 and 10, the method 1000 may include mounting the clips 933 to the clip supports 931 attached to the panel 70, 72 by inserting each panel mounting insert 951 of the clips 933 in the panel insertion direction PID into a corresponding mounting opening 937 on one of the clip supports 931 so as to extend into the corresponding vertically arranged slot 935 on the panel 70, 72. As shown in FIGS. 10 and 11, the method 100 may also include mounting the clips 933 to the vertical frame members 12 by inserting each frame mounting insert 949 in the frame insertion direction FID into a corresponding mounting opening 42, 46 on one of the vertical frame members 12. The clips 933 support the panel 70, 72 on the vertical frame members 12.

In the method 1000, the clips 933 may be mounted to the clip supports 931 attached to the panel before mounting the clips 933 to the vertical frame members 12. The method 1000 may also include mounting the clips 933 to the clip supports 931 attached to the panel 70, 72 after mounting the clips 933 to the vertical frame members 12.

Figure 12:
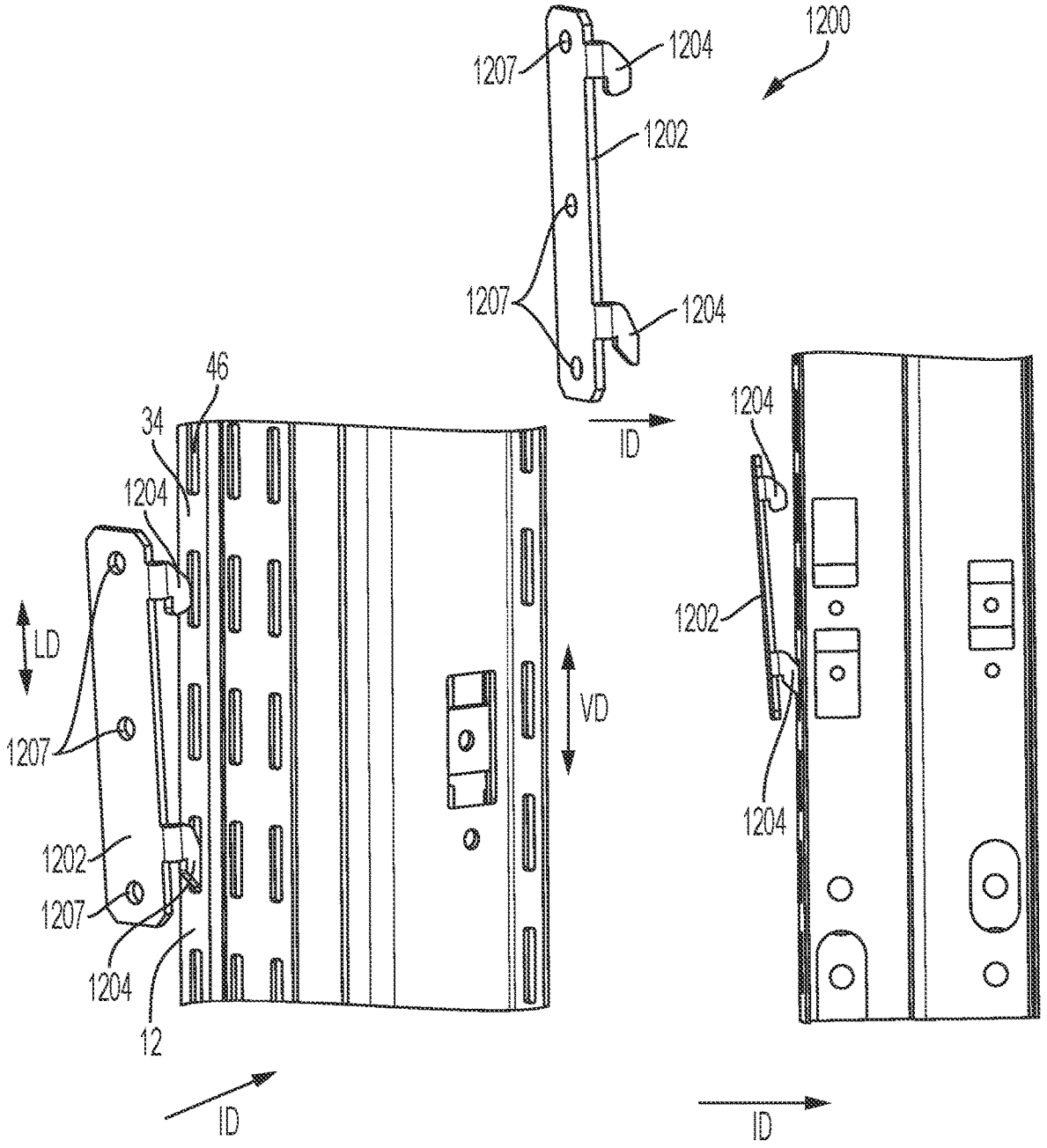
FIG. 12 shows an exemplary clip system for mounting a panel to an internal frame of a modular wall in accordance with another embodiment of the present patent application, where
Figure 13:
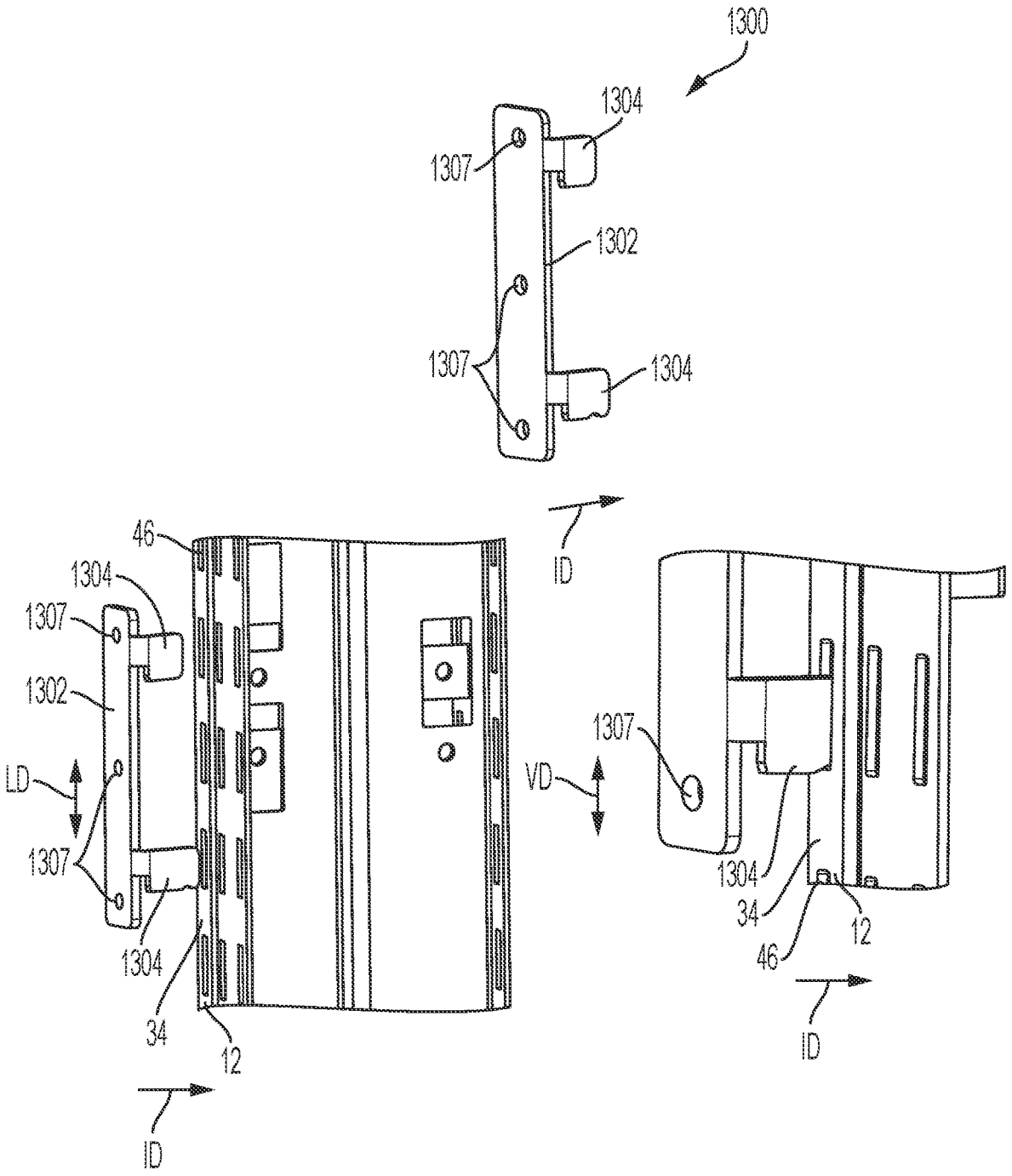
FIG. 13 shows an exemplary clip system for mounting a panel to an internal frame of a modular wall in accordance with yet another embodiment of the present patent application, where

FIGS. 12-13 show two clip systems 1200 and 1300 in accordance with two embodiments of the present patent application. The operation of these two clip systems 1200 and 1300 is similar to that of the clip 500 and, thus, will not be described in detail. The configuration of these two clip systems 1200 and 1300 is also similar to that of the clip 500, except for the minor design differences in the configuration of the mounting inserts as shown in FIGS. 12 and 13.

Any of the clips herein (or any other design thereof) attached to the panel may be attached in a recess formed in the inner or rear surface of the panel to reduce the structure of the clip protruding from the panel surface (or eliminate any protrusion, e.g., so a surface of the clip is flush with the panel surface). This may be used to save space between stacked panels, and/or ensure accuracy of placement (proper alignment/location) during assembly (either at the manufacturing location or at an installation site). Accuracy is enhanced because pre-forming the recesses in the panels will locate the clips to the proper location. For example, in FIG. 8 where the slot 935 is shown, recesses can be formed above and below the slot 935 to receive the first and second portions 941, 943, so the whole clip can be installed with less protrusion. Moreover, the slot 935 can sit within a larger rectangular recess extending about the slot 935 in which the clip can be received, allowing the surface of wall 945 to be flush or closer to flush with the panel. The same can be done with other embodiments to reduce the amount of protrusion and/or enhance installation accuracy/alignment of the clip component on the panel.

Any clips herein (or any other design thereof) attached to a panel may also be attached by barbs, adhesive, or other fasteners. For example, panels made of materials like gypsum may benefit from barb attachments instead of more traditional fasteners, like screws/nails. Or adhesive may be used in addition to barbs. Thus, no particular type of fastening to a panel is intended to be limiting.

The present patent application and its various embodiments as described above uniquely address the observed, noted and researched findings and improve on the prior and current state of the art systems. The listed products, features and embodiments as described in the present patent application should not be considered as limiting in any way.

Although the present patent application has been described in detail for the purpose of illustration, it is to be understood that such detail is solely for that purpose and that the present patent application is not limited to the disclosed embodiments, but, on the contrary, is intended to cover modifications and equivalent arrangements that are within the spirit and scope of the appended claims. In addition, it is to be understood that the present patent application contemplates that, to the extent possible, one or more features of any embodiment can be combined with one or more features of any other embodiment.

The illustration of the embodiments of the present patent application should not be taken as restrictive in any way since a myriad of configurations and methods utilizing the present patent application can be realized from what has been disclosed or revealed in the present patent application. The systems, features and embodiments described in the present patent application should not be considered as limiting in any way. The illustrations are representative of possible construction and mechanical embodiments and methods to obtain the desired features. The location and/or the form of any minor design detail or the material specified in the present patent application can be changed and doing so will not be considered new material since the present patent application covers those executions in the broadest form.

The foregoing illustrated embodiments have been provided to illustrate the structural and functional principles of the present patent application and are not intended to be limiting. To the contrary, the present patent application is intended to encompass all modifications, alterations and substitutions within the spirit and scope of the appended claims.

What is claimed is:

1. A panel and clip system for mounting the panel to an internal frame of a modular wall, the frame comprising vertical frame members with a plurality of vertically arranged mounting openings, the panel and clip system comprising:

said panel having at least a first series of two or more vertically arranged slots and a second series of two or more vertically arranged slots spaced laterally apart from the first series;

a plurality of clip supports each having at least one mounting opening formed therethrough, the clip supports being attached to the panel such that each clip support is positioned over a corresponding one of the vertically arranged slots with the mounting opening thereof aligned with the corresponding slot;

a plurality of clips each having a body, a frame mounting insert extending from the body in a frame insertion direction and into a corresponding said mounting opening on one of the vertical frame members, and a panel mounting insert extending in a panel insertion direction opposite the frame insertion direction and into a corresponding said mounting opening on one of the clip supports so as to extend into the corresponding vertically arranged slot on the panel.

2. A method of mounting a panel to at least two vertical frame members of an internal frame of a modular wall using the panel and clip system of claim 1, each vertical frame member having a plurality of vertically arranged mounting openings and the panel having the panel clips mounted thereto, the method comprising:

mounting the clips to the clip supports attached to the panel by inserting each panel mounting inserts of the clips in the panel insertion direction into the corresponding mounting opening on one of the clip supports so as to extend into the corresponding vertically arranged slot on the panel;

mounting the clips to the vertical frame members by inserting each frame mounting insert in the frame insertion direction into the corresponding mounting opening on one of the vertical frame members, wherein the clips support the panel on the vertical frame members.

3. The method according to claim 2, wherein mounting the clips to the clip supports attached to the panel is performed before mounting the clips to the vertical frame members.

4. The method according to claim 2, wherein mounting the clips to the clip supports attached to the panel is performed after mounting the clips to the vertical frame members.

* * * * *